US008002521B2

(12) United States Patent
Maltson

(10) Patent No.: US 8,002,521 B2
(45) Date of Patent: Aug. 23, 2011

(54) FLOW MACHINE

(75) Inventor: John David Maltson, Skellingthorp (GB)

(73) Assignee: Siemens Aktiengesellschaft, Munich (DE)

( * ) Notice: Subject to any disclaimer, the term of this patent is extended or adjusted under 35 U.S.C. 154(b) by 881 days.

(21) Appl. No.: 11/922,666

(22) PCT Filed: Jun. 22, 2006

(86) PCT No.: PCT/EP2006/063471

§ 371 (c)(1),
(2), (4) Date: Dec. 20, 2007

(87) PCT Pub. No.: WO2007/000409

PCT Pub. Date: Jan. 4, 2007

(65) Prior Publication Data

US 2009/0104029 A1 Apr. 23, 2009

(30) Foreign Application Priority Data

Jun. 28, 2005 (GB) ..... 0513144.6

(51) Int. Cl.
*F01D 9/04* (2006.01)

(52) U.S. Cl. ..... 415/175; 415/115; 415/191; 415/202; 415/208.1

(58) Field of Classification Search ..... 415/115, 415/175, 191, 202, 208.1
See application file for complete search history.

(56) References Cited

U.S. PATENT DOCUMENTS

| | | | | |
|---|---|---|---|---|
| 4,017,207 | A * | 4/1977 | Bell et al. | 415/115 |
| 5,997,245 | A * | 12/1999 | Tomita et al. | 415/115 |
| 6,227,798 | B1 | 5/2001 | Demers et al. | |
| 7,004,721 | B2 * | 2/2006 | Imbourg et al. | 415/115 |
| 2002/0122716 | A1 | 9/2002 | Beacock et al. | |

FOREIGN PATENT DOCUMENTS

| | | |
|---|---|---|
| DE | 2 065 334 | 4/1973 |
| DE | 28 47 012 A1 | 5/1979 |
| EP | 1 249 575 A1 | 10/2002 |

* cited by examiner

*Primary Examiner* — Igor Kershteyn

(57) ABSTRACT

A flow machine is described having a first space adapted to contain a hot fluid and delimited by a wall. The wall having a first wall surface facing the first space and a second wall surface turned away from the first space. Cooling is provided for a region of the wall by supplying a relatively cool fluid onto the second wall surface. The cooling means includes a supply chamber containing the second fluid, a cavity adjacent the second wall surface, at least one duct, which has an inlet opening at the supply chamber and an outlet opening at the cavity for conveying the cool fluid to the cavity, and a deflection surface facing the cavity.

16 Claims, 6 Drawing Sheets

FLOW MACHINE

CROSS REFERENCE TO RELATED APPLICATIONS

This application is the US National Stage of International Application No. PCT/EP2006/063471, filed Jun. 22, 2006 and claims the benefit thereof. The International Application claims the benefits of British application No. 0513144.6 filed Jun. 28, 2005, both of the applications are incorporated by reference herein in their entirety.

FIELD OF INVENTION

The present invention refers generally to a flow machine, such as a gas turbine engine, a turbocharger, a combustion chamber, a secondary combustion chamber, a rocket and the like. More specifically, the present invention refers to a flow machine having a first space adapted to contain a first, relatively hot fluid and being delimited by means of a wall, which has a first wall surface facing the first space and a second wall surface turned away from the first space, the flow machine including cooling means for cooling a region of the wall by supplying a second, relatively cool fluid onto the second wall surface, the cooling means including a supply chamber adapted to contain the second fluid, a cavity arranged immediately adjacent to the second wall surface, at least one duct, which has an inlet opening at the supply chamber and an outlet opening at the cavity and is adapted to convey the relatively cool fluid from the supply chamber to the cavity, wherein an extension plane extends through the outlet opening and intersects the second wall surface, and a structure presenting a deflection surface facing the cavity and adapted to re-direct the second fluid from the duct towards the second wall surface.

BACKGROUND OF THE INVENTION

In such flow machines, the hot fluid, e.g. hot combustion gases, contained in the first space give rise to high temperatures in various components and regions of components. Consequently, these components require to be cooled efficiently in order to be able to guarantee reliability and a long life time of the flow machine.

An example of a component that requires such efficient cooling is the wall of a guide vane platform in a gas turbine engine, especially a wall of the guide vane platform of the high pressure guide vane stage, where the hot combustion gases have a very high temperature.

A known cooling arrangement for such a platform wall is defined above and disclosed in FIG. 1 attached hereto. FIG. 1 shows a first space 1 through which the hot combustion gases may flow. The first space 1 is delimited by wall 2 of the platform 3 to which the aerofoil 4 of the guide vane is attached. The wall 2 has a first wall surface 2*a* facing the first space 1 and a second wall surface 2*b* turned away from the first space 1. Cooling means is provided for cooling rear region of the wall 2 by supplying a relatively cool fluid onto the second wall surface 2*b*. A supply chamber 6 contains the relatively cool fluid. A cavity 7 is arranged immediately adjacent to the second wall surface 2*b* and at least one duct 8 extends from the supply chamber 6 to the cavity 7 and conveys the relatively cool fluid from the supply chamber 6 to the cavity 7. A rotor shroud segment 9 presents a deflection surface 9*a* facing the cavity. The deflection surface 9*a* redirects the cool fluid from the duct 8 towards the second wall surface 2*b*.

As can be seen in FIG. 1, the deflection surface 9*a* extends along a straight line in an axial plane. The deflection surface 9*a* is curved in a circumferential direction perpendicular to the axial plane. It has now been recognised that the cooling arrangement does not provide any significant heat transfer to the rear region of the wall 2, which means that the cooling of the rear region of the wall 2 will be insufficient or that a quantity of cool fluid to be supplied will be unacceptably high.

SUMMARY OF THE INVENTION

The object of the present invention is to overcome the problems mentioned above. A further object is to provide a more efficient cooling of a wall delimiting a hot fluid space in a flow machine. A still further object is to provide a cooling requiring a moderate quantity of cooling fluid and making efficient use of the available cooling fluid and its kinetic energy controlled by the available pressure drop. A more specific object is to provide a more efficient cooling of a rear region of the wall of a platform of a guide vane, especially the high pressure guide vane, in a gas turbine engine.

This object is achieved by the flow machine initially defined, which is characterised in that the deflection surface has a concave surface portion, which is concave in said extension plane and adapted to re-direct the second fluid that leaves the duct so that it impinges substantially directly on the second wall surface thereby to cool the wall in said region.

By such a deflection surface including a concave surface portion, cool fluid in the form of a jet or a plurality of jets from the ducts will be more smoothly deflected through a large angle to impinge directly on the second wall surface. The impingement effect increases the heat transfer coefficient on the second wall surface, and thus an efficient cooling of the rear region of the wall is achieved. Furthermore, the design of the deflection surface results in a proper distribution of the cool fluid in a circumferential direction.

According to an embodiment of the invention, the concave surface portion is curved along a curve in said extension plane. Such a smooth, curved surface permits an advantageous smooth deflection of the cool fluid.

According to a further embodiment of the invention, the flow machine is designed to permit the first fluid to flow through the machine in a main flow direction, wherein the duct has a centre line being approximately parallel to the main flow direction. Advantageously, the centre line intersects the deflection surface at least in the proximity of the concave surface portion. In such a way, it is ensured that the jet of cool fluid is smoothly deflected by the deflection surface.

According to a further embodiment of the invention, the concave surface portion is substantially elliptic with respect to the extension plane. It is to be noted that any curvature of higher order degrees may be employed, but an elliptic, especially circular, curvature is advantageous from a manufacturing point of view.

According to a further embodiment of the invention, the deflection surface has an initial surface portion upstream the concave surface portion, wherein the initial surface portion slopes substantially straight towards the second wall surface with an angle $\alpha$. Preferably, $\alpha$ is determined by the limits $\alpha \leqq 40°$ and $\alpha \geqq 10°$.

According to a further embodiment of the invention, the deflection surface has an end surface portion downstream the concave surface portion, wherein the end surface portion slopes substantially straight towards the second wall surface with an angle $\beta$. Preferably, is determined by the limits $\beta \geqq 60°$ and $\beta \leqq 90°$.

According to a further embodiment of the invention, the duct has an average cross-section dimension, and thus a flow area, that is relatively small. Such a relatively small flow area will provide an efficient cooling with a small consumption of the second cool fluid.

According to a further embodiment of the invention, the centre line is located at a perpendicular distance d from the second wall surface, wherein d≧1 time the average cross-section dimension. Preferably, d≦10 times the average cross-section dimension.

According to a further embodiment of the invention, the second surface portion has a length downstream the duct, which length is at least 10 times the average cross-section dimension of the duct. Preferably, the length of the second surface portion is less than 50 times the average cross-section dimension of the duct.

According to a further embodiment of the invention, the cooling means includes a plurality of such ducts arranged beside each other. The number of ducts and the distance between the ducts may be adapted to the actual application of the cooling means.

According to a further embodiment of the invention, the structure presents a further surface extending downstream the deflection surface and substantially in parallel with the second wall surface in said region thereof. Advantageously, the deflection surface has a length along the main flow direction and the further surface has a length along the main flow direction, wherein the length of the further surface is longer than the length of the deflection surface. In addition, the distance d between the centre line and the second wall surface may advantageously be greater than a perpendicular distance between the further surface and the second wall surface. In such a way, a relatively thin passage for the relatively cool fluid is created between the second wall surface and the further surface, which provides for an efficient cooling also of the rear downstream end of the second wall surface.

According to a further embodiment of the invention, the supply chamber includes a first chamber space and a second chamber space being separated from the first chamber space by a perforated plate, wherein the duct extends from the second chamber space. Preferably, the wall has a third wall surface facing the supply chamber. the third wall surface facing the second chamber space, wherein the perforated plate is adapted to guide the second fluid through the perforated plate so that it impinges substantially directly on the third wall surface thereby to cool the wall. In such a way the wall is efficiently cooled also with respect to the third wall surface.

According to a further embodiment of the invention, the flow machine has a centre axis, the cavity having a circumferential extension around the centre axis. The ducts may then be approximately evenly distributed along the circumferential extension. Moreover, the centre line of each of the ducts may be approximately parallel to the centre axis. Also the main flow direction may be approximately parallel to the centre axis.

According to a further embodiment of the invention, the flow machine is a gas turbine engine. The cooling means according to the invention is advantageous in such an application where the relatively hot fluid, i.e. the combustion gases, reaches very high temperatures. The wall may then be included in a platform of at least one guide vane in the gas turbine engine. Moreover, the wall may be arranged to extend in a circumferential direction around the centre axis, and be formed by a plurality of platforms forming a guide vane stage with a plurality of aerofoils. The gas turbine engine may include a plurality of guide vane stages, wherein said guide vane stage forms a first, upstream guide vane stage. The cooling means of this invention is advantageous for the first, upstream guide vane stage having a generally higher temperature due to the high pressure. However, the cooling means of the invention is advantageous also for more downstream guide vane stages, e.g. for cooling local spots having a raised temperature. The structure may include a rotor shroud segment of the gas turbine machine.

BRIEF DESCRIPTION OF THE DRAWINGS

The invention is now to be explained more closely by means of a description of various embodiments and with reference to the drawings attached hereto.

DETAILED DESCRIPTION OF THE INVENTION

Figure 1:
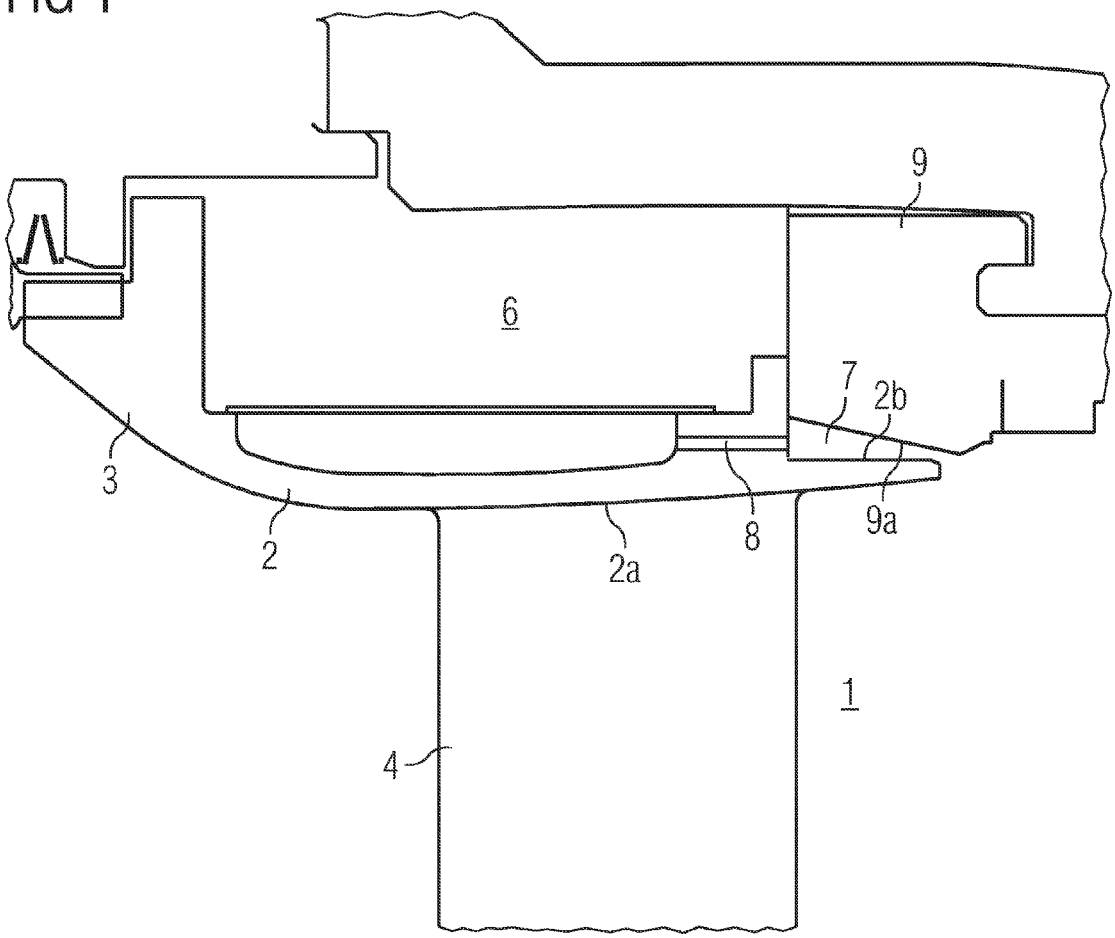
FIG. 1 shows schematically a cooling arrangement for a guide vane platform according to the prior art.
Figure 2:
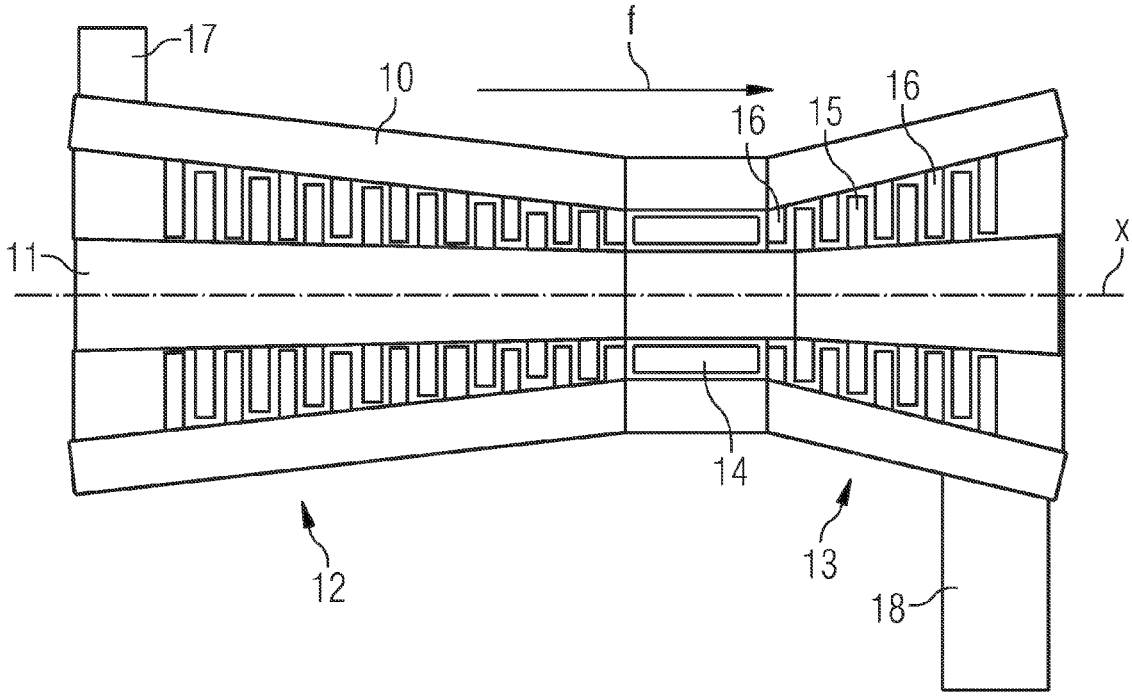
FIG. 2 shows schematically a longitudinal section through a gas turbine engine.
Figure 3:
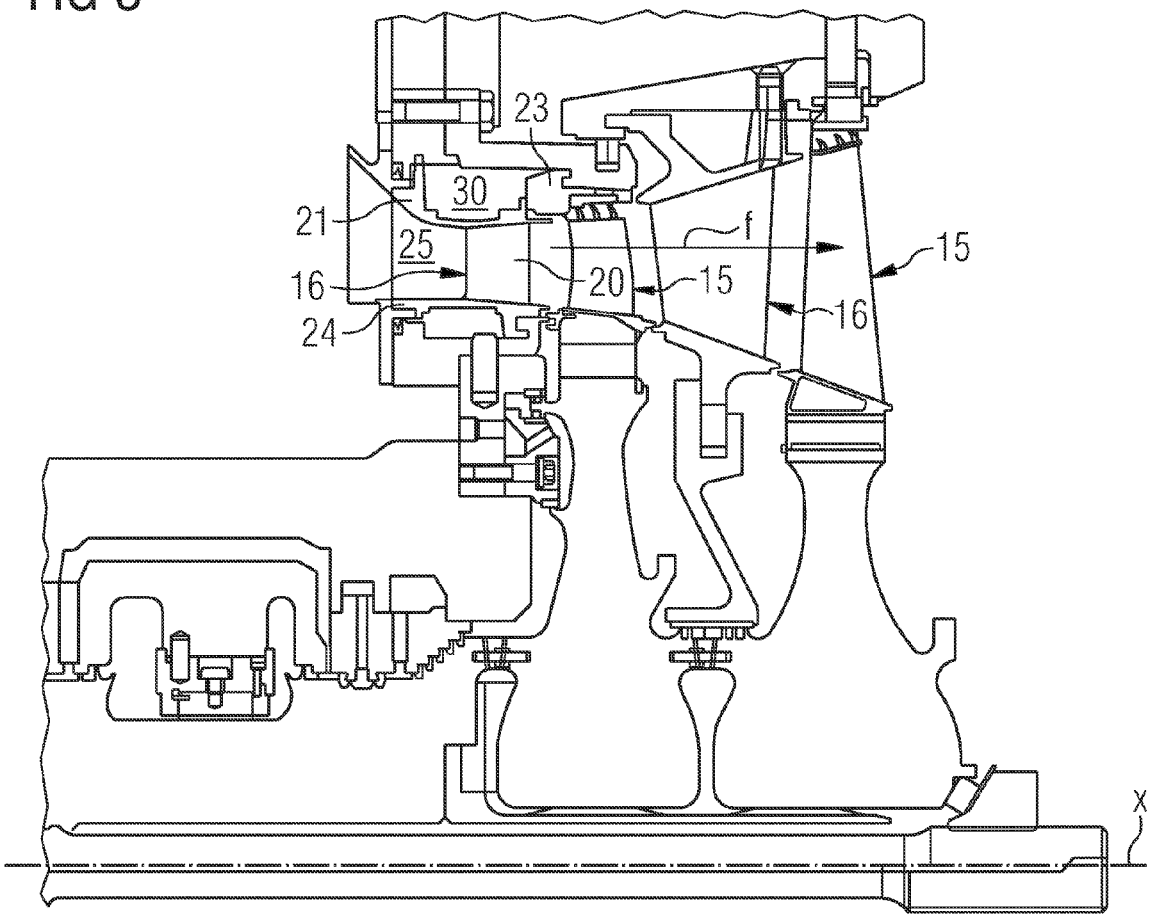
FIG. 3 shows schematically a section through a high pressure portion of the gas turbine engine with cooling means according to the invention.
Figure 4:
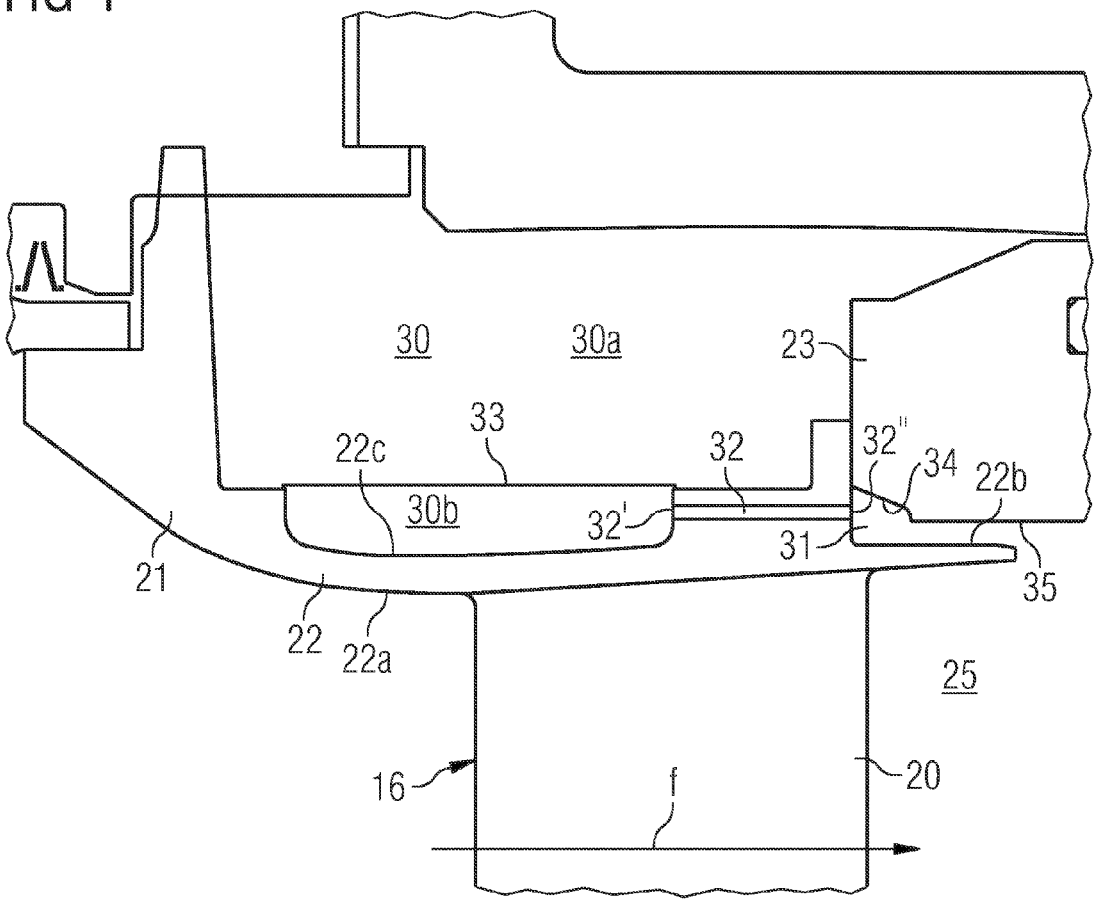
FIG. 4 shows schematically a guide vane platform with cooling means according to the invention.

The present invention is now to be explained more closely with reference to FIGS. 2-7. FIG. 2 discloses a gas turbine engine. The present invention is advantageously applicable to such a gas turbine engine. Although the invention will be explained in connection with a gas turbine engine, it is to be noted that the invention is also applicable to other flow machines, for instance a turbocharger, a combustion chamber, a secondary combustion chamber, a rocket and the like.

The gas turbine engine has a stationary housing 10 and a rotor 11, which is rotatable in the housing 16 around a centre axis x. The gas turbine has a compressor part 12 and a turbine part 13. A combustion chamber arrangement 14 is, in a manner known per se, arranged between the compressor part 12 and the turbine part 13 for generating hot combustion gases. The turbine part 13 includes a number of rotor blades 15 mounted to the rotor 11 and a number of stationary guide vanes 16 mounted to the housing 10. A fluid, such as air, is fed to the gas turbine engine via an inlet 17 through the compressor part 12 and the combustion chamber arrangement 14 where the air is heated to form hot combustion gases which are then conveyed to an outlet 18 through the turbine part 13 for producing mechanical energy in a manner known per se. The fluid flows through the gas turbine engine in a main flow direction f, which is approximately parallel to the centre axis x. The expression "downstream" and "upstream" used in this application relate to the main flow direction.

The first set of guide vanes 16 located immediately downstream the combustion chamber arrangement 14 are called the high pressure guide vanes 16. This set of high pressure guide vanes 16 are disclosed more closely in FIG. 3. Each guide vane 16 in the set of high pressure guide vanes 16 includes an aerofoil 20 extending in an approximately radial direction with respect to the centre axis x and a platform 21 for the mounting of the guide vane 16 in the housing 10. Each guide vane 16 also have an inner platform 24 for forming a stationary, annular supporting structure at a radially inner position of the aerofoils 20. Immediately downstream the high pressure guide vane stage, there is the first rotor stage including a number of rotor blades 15. Outside the rotor blades 15 a number of rotor shroud segments 23 are arranged to extend circumferentially around the centre axis x and the rotor blades 15. Also the platforms 21 in the high pressure guide vane stage are arranged to extend circumferentially around the centre axis x. Each platform 21 is arranged adjacent to a first space 25 forming the flow passage for the hot combustion gases. Consequently, the platforms 21 need to be cooled. Each platform 21 includes a wall 22 having a first wall surface 22*a* facing the first space 25 and a second wall surface 22*b* turned away from the first space 25 and a third wall surface 22*c* also turned away from the first space 25, see FIG. 4. The second wall surface 22*b* is located at a rear region of the platform 21 with respect to the main flow direction and the third wall surface 22*c* at an upstream, intermediate region.

Cooling means are provided for cooling the wall 22 of the platform 21. The cooling means includes a supply chamber 30, which is adapted to contain a second relatively cool fluid. The second fluid may be for instance air or carbon dioxide arriving directly from the compressor part 11 of the gas turbine engine without passing through the combustion chamber arrangement 14. The second fluid may also contain components, such as steam or carbon dioxide, which has been added downstream the compressor part. The second fluid may also be contained in a closed cooling circuit for a flow machine such as a gas turbine. Furthermore, the cooling means includes a cavity 31 arranged immediately adjacent to the second wall surface 22*b*. The cavity 31 extends in a circumferential direction with respect to the centre axis x. The cavity 31 may be annular but the extension of the cavity 31 may also be interrupted by for instance various partitions (not disclosed). At least one duct 32 extends from the supply chamber 30 to the cavity 31. The duct 32 has an inlet opening 32' at the supply chamber 30 and an outlet opening 32" at the cavity 31. An extension plane p, q extends, in the embodiment disclosed, through the inlet opening 32' and the outlet opening 32" and intersects the second wall surface 22*b*. It should be noted, however, that the extension plane p, q may have a different extension, i.e. the extension plane p, q does not have to go through the inlet opening 32'. It is sufficient that the extension plane p, q extends through the outlet opening 32" and intersects the second wall surface 22*b*. In the embodiment disclosed a plurality of such ducts 32 are provided and arranged beside each other. The ducts 32 are approximately evenly distributed along the circumferential extension of the cavity 31, see FIG. 7.

The supply chamber 30 includes a first chamber space 30*a* and a second chamber space 30*b*. The first chamber space 30*a* is separated from the second chamber space 30*b* by a perforated plate 33. The ducts 32 extends from the second chamber space 30*b* of the supply chamber 30. The third wall surface 22*c* faces the supply chamber 30 and more precisely the second chamber space 30*b* of the supply chamber 30. The perforated plate 33 is adapted to guide the second fluid through the perforated plate 33 in such a way that the fluid impinges substantially directly on the third wall surface 22*c* for efficient cooling of the wall 22 in the intermediate region.

The ducts 32 are thus adapted to convey the second fluid from the supply chamber 30, i.e. the second chamber space 30*b* to the cavity 31. The rotor shroud segment 23 forms a structure that presents a deflection surface 34 facing the cavity 31 and adapted to re-direct the second fluid.

Figure 5:
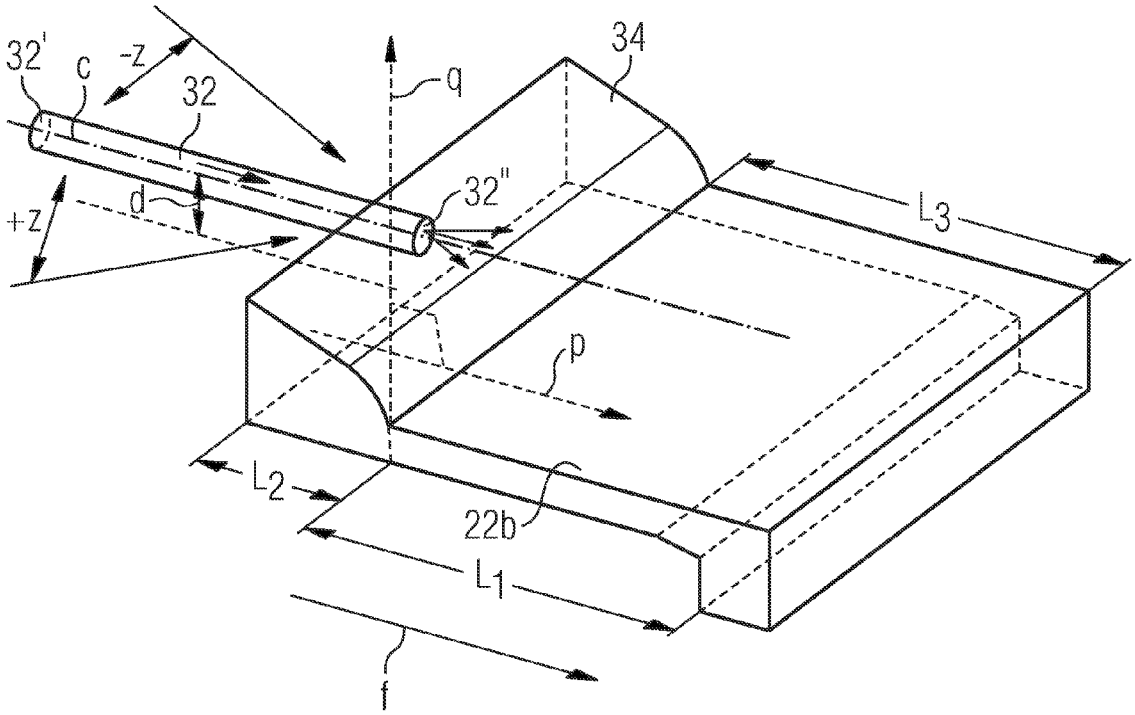
FIG. 5 shows a principal perspective view of a circumferential space formed above the platform in FIG. 4.
Figure 6:
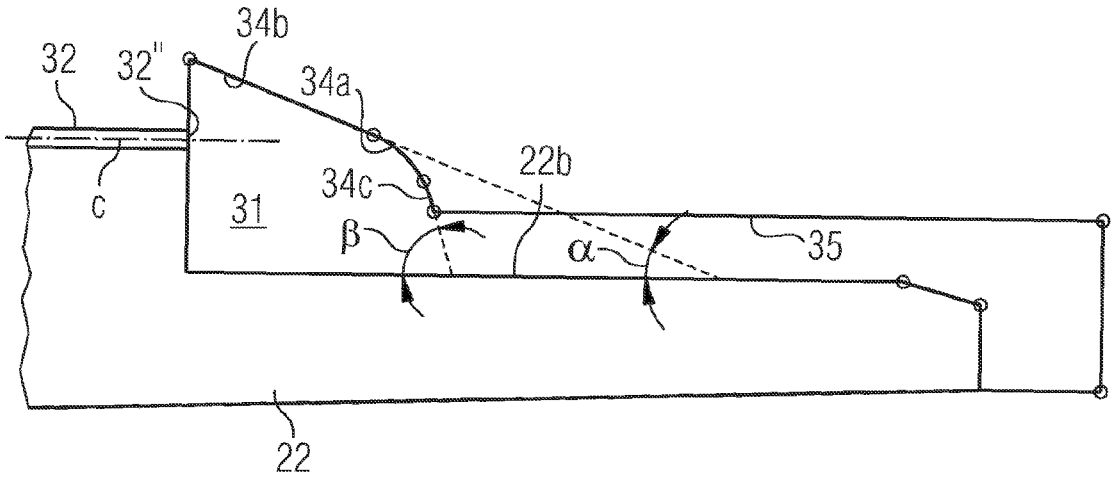
FIG. 6 shows in a radial section the shape of the circumferential space in FIG. 5.
Figure 7:
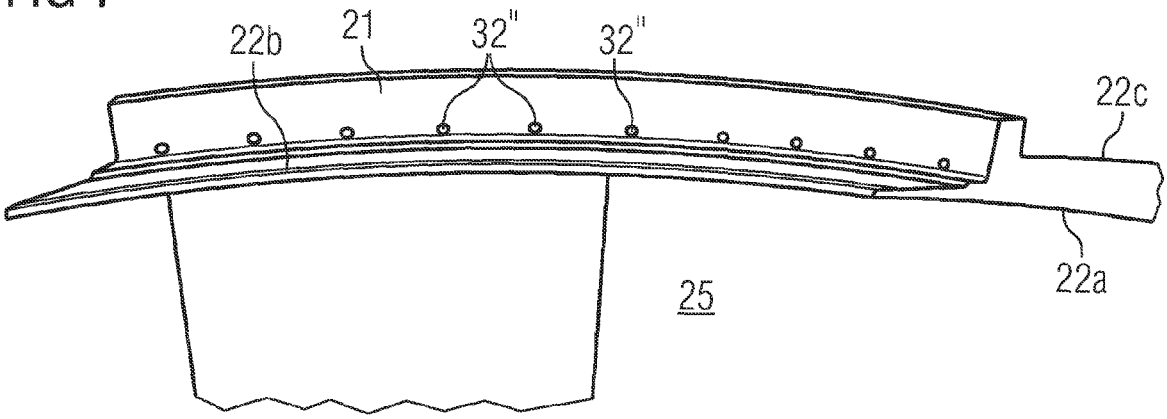
FIG. 7 shows schematically a part of a circumferential platform structure having a plurality of ducts.

The deflection surface 34 has a concave surface portion 34*a*, see FIGS. 5 and 6. The concave surface portion 34*a* is in the embodiments disclosed curved along a curve in the above mentioned extension plane p, q and adapted to redirect the second fluid that leaves ducts 32 so that the second fluid impinges substantially directly on the second wall surface 22*b*. The design of the concave surface portion also promotes a uniform distribution of the second fluid in a circumferential direction. It is also to be noted that the concave surface portion also may be formed by a number of surface sections that are substantially straight in the extension plane p, q. The number of such surface sections may for instance be 3, 4, 5, 6 or more.

Each duct 32 has a centre line c which is approximately parallel to the main flow direction f. However, the ducts 32 may not only be straight but may have a somewhat curved extension from the supply chamber 30 to the cavity 31. The ducts 32 may also be inclined somewhat upwardly or downwardly with respect to the centre axis x. Furthermore, as appears from FIG. 5, the above mentioned extension plane p, q of each duct 32 may at least approximately coincide with an axial plane including the centre axis x, or the ducts 32 may be laterally inclined with respect to a radial plane including the centre axis x. This lateral inclination is indicated by the double arrows +z and −z in FIG. 5. However, the ducts 32 are designed in such away that the centre line c will intersect the deflection surface 34 at least in the proximity of the concave surface portion 34*a*. The concave surface portion 34*a* may have any suitable concave curvature, for instance elliptic, especially circular, hyperbolic, polynomial or defined by a trigonometric function. It should also be noted that in case the ducts 32 are laterally inclined as mentioned above, the deflection surface 34, especially the concave surface portion 34*a*, may be discontinuous in a circumferential direction and present a respective small individual surface area for each duct 32, so that the jet from the respective duct 32 will hit the individual surface area at an adapted proper angle.

The deflection surface 34 also has a initial surface portion 34*b* arranged immediately upstream the concave surface portion 34*a*, wherein the initial surface portion 34*b* slopes substantially straight towards the second wall surface 22*b* with an angle $\alpha$. $\alpha$ is preferably larger than or equal to 10° and smaller than or equal to 40°, e.g. about 35°. The deflection surface 34 also has an end surface portion 34*c* arranged immediately downstream the concave surface portion 34*a*. The end surface portion 34*c* slopes substantially straight towards the second wall surface 22*b* with an angle $\beta$. $\beta$ is preferably larger than or equal to 60° and smaller than or equal to 90°, e.g. about 75°. It is to be noted that the initial surface portion 34*b* and the end surface portion 34*c* in the embodiment disclosed are straight or approximately straight in a plane including the centre axis x of the gas turbine engine. It is to be noted that one or both of these surfaces could have a certain curvature also in the plane including the centre axis.

Each of the ducts 32 has an average cross-section dimension that is relatively small. Consequently, the flow area of each of the ducts 32 is relatively small so that the consumption of the second fluid for the cooling will be relatively low. In the embodiment disclosed, each duct 32 has a circular cross-section shape. The ducts 32 may, however, have any suitable cross-section shape. The centre line c is located at a perpendicular distance d from the second wall surface 22*b*. The distance d is larger than or equal to the average cross-section dimension of each duct 32 and smaller than or equal to ten times the average cross-section dimension of each duct 32.

The second surface portion 22*b* has a length $L_1$ downstream the duct 32, which length $L_1$ is at least ten time the average cross-section dimension of each duct 32 and less than 50 times the average cross-section dimension of each duct 32.

The structure also presents a further surface 35 extending downstream the deflection surface 34 and substantially in parallel with the second wall surface 22*b* in the rear region. The deflection surface 34 has a length $L_2$ along the main flow direction f and the further surface 35 has a corresponding length $L_3$ along the main flow direction f. The length $L_3$ of the further surface 35 is longer than the length $L_2$ of the deflection surface 34 along the main flow direction f. The distance d between the centre line c and the second wall surface 22*b* is greater than a perpendicular distance between the further surface 35 and the second wall surface 22*b*. Consequently, a relatively thin passage is formed between the second wall surface 22*b* and the further surface 35 for the second fluid, providing for an efficient cooling also of the rearmost part of the second wall surface 22*b*. The height of this passage could for instance be about 1 mm. The height will of course vary with the application of the cooling means, for instance the size of the gas turbine engine. In addition, the second wall surface 22*b* could be provided with surface irregularities at least in the area of the passage, in order to improve the heat transfer. Such surface irregularities could include dimples or, in case the height of the passages so permits, fins or other projections of various shapes.

The present invention is not limited to the embodiments disclosed but may be varied and modified within the scope of the following claims. In addition to the possibilities of applying the invention in other kinds of flow machines as mentioned above, the cooling means could also be applied to the inner platform 24 of a guide vane 16 in a gas turbine engine.

The invention claimed is:

1. A flow machine, comprising:

a first space that contains a first hot fluid and being delimited by a wall that has a first wall surface facing the first space and a second wall surface opposite the first space; and a cooling device for cooling a region of the wall by supplying a second fluid onto the second wall surface where the second fluid is relatively cooler than the first hot fluid, wherein the cooling device comprises:

a supply chamber that contains the second fluid, a cavity arranged immediately adjacent the second wall surface, a duct having an inlet opening arranged at the supply chamber and an outlet opening arranged at the cavity and is adapted to convey the second fluid from the supply chamber to the cavity, where an extension plane extends through the outlet opening and intersects the second wall surface, and a deflection surface facing the cavity and adapted to re-direct the second fluid from the duct towards the second wall surface, wherein the deflection surface has a concave surface portion that is concave in the extension plane and adapted to re-direct the second fluid that leaves the duct such that it impinges substantially directly on the second wall surface to cool the wall, wherein the concave surface portion is curved along a curve in the extension plane, wherein the flow machine is constructed and arranged such that the first fluid flows through the machine in a main flow direction, wherein the duct has a centre line essentially parallel to the mainflow direction, wherein the centre line intersects the deflection surface at least in the proximity of the concave surface portion, wherein the deflection surface has an initial surface portion upstream the concave surface portion, wherein the initial surface portion slopes substantially straight towards the second wall surface with an angle $\alpha$, where $10° \leqq \alpha \leqq 40°$.

2. A flow machine according to claim 1, wherein the concave surface portion is substantially elliptic with respect to the extension plane.

3. A flow machine according to claim 1, wherein the deflection surface has an end surface portion downstream the concave surface portion, wherein the end surface portion slopes substantially straight towards the second wall surface with an angle $\beta$, where $60° \leqq \beta \leqq 90°$.

4. A flow machine according to claim 1, wherein the centre line is located at a perpendicular distance d, from the second wall surface, where $10 \geqq d \geqq 1$ times the average cross-section dimension.

5. A flow machine according to claims 4, wherein the second surface portion has a length L, downstream the duct where $10 \leqq L < 50$ times the average cross-section dimension of the duct.

6. A flow machine according to claim 1, wherein the cooling device includes a plurality of ducts arranged beside each other.

7. A flow machine according to claim 1, further comprising a further surface extending downstream the deflection surface and substantially in parallel with the second wall surface.

8. A flow machine according to claim 7, wherein the deflection surface has a length along the main flow direction and that the further surface has a length along the main flow direction, wherein the length of the further surface is longer than the length of the deflection surface.

9. A flow machine according to claim 8, wherein the distance between the centre line and the second wall surface is greater than a perpendicular distance between the further surface and the second wall surface.

10. A flow machine according to claim 1, wherein the supply chamber includes a first chamber space and a second chamber space being separated from the first chamber space by a perforated plate, wherein the duct extends from the second chamber space.

11. A flow machine according to claim 1, wherein the wall has a third wall surface facing the supply chamber.

12. A flow machine according to claim 11, wherein the third wall surface faces the second chamber space, wherein the perforated plate is adapted to guide the second fluid through the perforated plate so that it impinges substantially directly on the third wall surface to cool the wall.

13. A flow machine according to claim 1, wherein the flow machine has a centre axis, the cavity having a circumferential extension around the centre axis and the ducts are approximately evenly distributed along the circumferential extension.

14. A flow machine according to claim 13, wherein the centre line of each of the ducts is essentially parallel to the centre axis, and the main flow direction is essentially parallel to the centre axis.

15. A flow machine according to claim 14, wherein the wall is arranged to extend in a circumferential direction around the centre axis, and formed by a plurality of platforms forming a guide vane stage with a plurality of aerofoils of a gas turbine engine.

16. A flow machine according to claim 15, wherein the gas turbine engine includes a plurality of guide vane stages, wherein the guide vane stage forms a first, upstream guide vane stage, and the structure includes a rotor shroud segment of the gas turbine engine.

* * * * *